US005388663A

United States Patent [19]

Phillippe et al.

[11] Patent Number: 5,388,663

[45] Date of Patent: Feb. 14, 1995

[54] PORTABLE WALKWAY SYSTEMS

[76] Inventors: Michel Phillippe, 2840 Bouvier Road, Hammond, Ontario, Canada K0A 2A0; Ernest Phillippe, 2743 Dunning Road, Sarsfield, Ontario, Canada K0A 3E0; Marc Phillippe, 2214 Russland Road, Vars, Ontario, Canada K0A 3H0

[21] Appl. No.: 162,932

[22] Filed: Dec. 8, 1993

[51] Int. Cl.[6] ..... E04G 3/08

[52] U.S. Cl. ..... 182/82; 248/235; 248/246

[58] Field of Search ..... 182/82; 248/235, 244–246, 248/354.1

[56] References Cited

U.S. PATENT DOCUMENTS

| | | | |
|---|---|---|---|
| 26,840 | 1/1860 | Scaffold | 248/244 X |
| 541,323 | 6/1895 | Gewiss | 248/235 X |
| 834,919 | 11/1906 | Mackie | 248/235 |
| 1,716,904 | 6/1929 | Siderits | 248/354.1 X |
| 2,116,831 | 5/1938 | Hoy | 248/235 X |
| 2,577,979 | 12/1951 | Pierson | 248/235 |
| 2,891,759 | 6/1959 | Holmboe | 248/246 X |
| 3,698,680 | 10/1972 | Shoemaker | 182/82 X |
| 4,819,900 | 4/1989 | Funk | 248/244 |
| 5,307,899 | 5/1994 | Lubinski | 182/82 X |

FOREIGN PATENT DOCUMENTS

| | | | |
|---|---|---|---|
| 64238 | 9/1992 | Germany | 248/244 |

*Primary Examiner*—Alvin C. Chin-shue

[57] ABSTRACT

A scaffolding system that is based on metal clamps that can be used with on-site lumber to provide an elevated walkway. The scaffolding does not hang from the wall against which it is positioned, permitting such wall to subside during construction, as when it is filled with concrete.

2 Claims, 3 Drawing Sheets

PORTABLE WALKWAY SYSTEMS

FIELD OF THE INVENTION

This invention relates to portable or temporary walkways akin to scaffolding. More particularly it relates to a "kit" and procedure for erecting a walkway that may be used to pour concrete into a preformed wall.

BACKGROUND OF THE INVENTION

Walkways based on scaffolding customarily require erection of a frame to support planks that form the walking surface. At construction job sites, the transport and erection of fabricated scaffold units is costly and inconvenient.

In the erection of poured concrete walls based on the use of lightweight foamed plastic blocks with hollow cores, a walkway of from 5 to 8 feet in height is usually sufficient. The cores of such walls—"foam-form" walls—are then filled with poured concrete by standing on the walkway. This class of poured concrete wall is distinct in that before the concrete is poured, the wall-forms are fragile and cannot support substantial weight.

Typical construction job sites consume substantial quantities of standard size lumber. This lumber, typically of a "2 by 4" format (presently 1½ inches by 3½ inches in North America), forms a standard component in the framing of interior walls. Lumber of this type is therefore generally available on a job site, or can be brought in, by the time that the concrete walls are to be poured.

This invention provides a system for utilizing standard job site lumber on a temporary basis to form a walkway. It does so in a manner which allows such lumber to be incorporated into the building without being wasted. Furthermore, the invention is based on a "kit" that is compact, easily transported and fully reuseable.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

The invention in its most general sense is directed to a kit of parts for erecting a temporary walkway, the kit comprising:

(1) walkway brackets to carrying a lumber walking surface;

(2) a fastening ring for attaching the brackets to a vertical piece of lumber to be re-used subsequently, and optionally;

(3) clamps for producing extended lengths of lumber from shorter pieces, whereby such extended lengths may be used as braces.

On the job site, a walkway according to the invention is erected by installing vertical posts, preferably formed by nailing together pairs of two by four lumber pieces. These posts, in one variant, are notched on one side, the side to face the wall to be worked-on, with a shallow notch which is intended to receive the fastening ring. In the case of paired 2×4 lumber posts this ring may be rectangular and dimensioned to just slide down the vertical posts. At the notch, one the side of the ring is dropped in, allowing a space to develop on the other side of the ring.

The walkway brackets are each provided with an engaging leg that fits between the post and the ring. The brackets also have a horizontal bar to serve as a walkway lumber support, a downwardly angled brace, and a post-contacting thrusting flange at the lower end of the brace.

By hooking the walkway bracket engaging leg onto the fastening ring and placing the thrusting flange against the support post beneath this connection, a sturdy support bar is formed that can carry walkway lumber to form a walkway.

The support posts may be braced perpendicularly along side the wall to be poured by pieced-up 2×4 lumber held together by the clamps.

Along the face of the wall to be poured, or the form work for such wall, "hat-shaped" wall brackets may be placed around the support posts. Flanges formed on the wall brackets may then be fastened to the form-work for the wall to provide vertical support for the posts.

In the case of foam-form walls, it is important that the wall brackets be fastened to steel reinforcement or other solid stiffeners that are incorporated into the wall. This may conveniently be done by using self-tapping screws.

Another feature of foam-form walls is that the foam forms will often settle during the pouring of concrete. The system of the walkway supports of the present invention is particularly suited to such cases because the top-hat shaped wall brackets, if not fastened to the support posts, will allow the wall to subside or compress vertically without impairing the integrity of the support provided to the walkway.

For the same reasons the walkway support system of the invention may be used to erect a walkway adjacent to a structurally weak vertical structure, such as a chain-link fence. Its use is not, therefore restricted to foam walls, although this is a preferred application.

The above system, once a wall has been poured, may be readily disassembled. Where walls of several stories height are to be constructed, the internal flooring is generally added progressively. Each floor as it is added may serve as a base to erect the walkway system to support a further concrete pour.

At the conclusion of the concrete-pouring portion of the job, the lumber used to support the walkway may be returned for use as structural framing. Because the notch formed in the support posts is shallow, no significant loss of strength occurs.

As a variant, the fastening ring may be in the form of a dismantleable rectangle whereby one side may be slid through a hole drilled in the support post. As such a hole may be small in diameter, it will not preclude subsequent use of such lumber for structural framing. Use of such a hole is convenient where the 2×4 posts are to be moved and it is desired to ensure that the fastening ring will remain in place during any transfers.

An advantage of the invention is that upon conclusion of use of the walkway, only a small amount of hardware needs to be removed from the job site, for subsequent re-use. Further, the lumber that is required is not consumed, but rather is only temporarily "borrowed".

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 1:
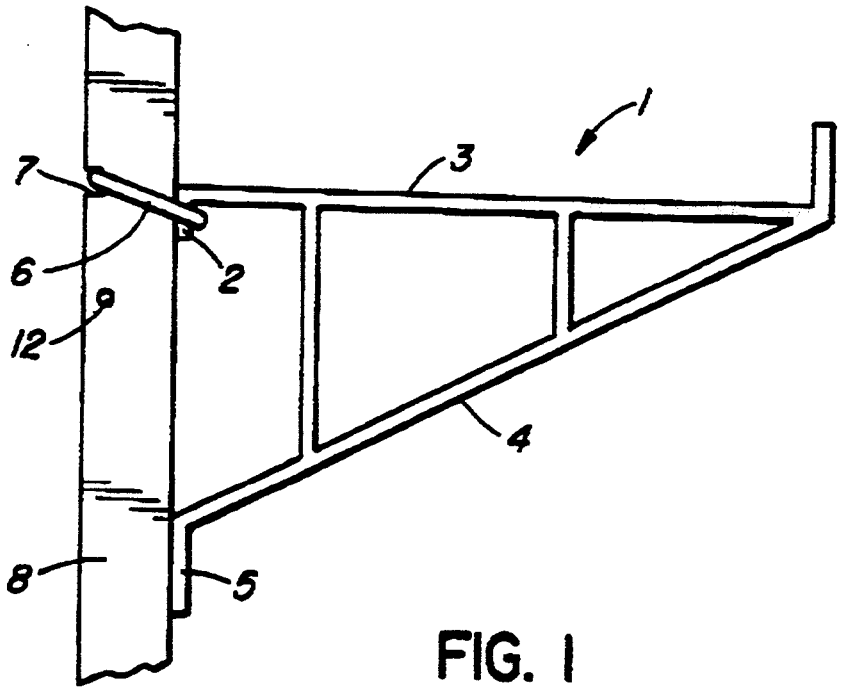
FIG. 1 is a side view of a walkway bracket engaged to a fastening ring held by a vertical post.

FIG. 1 shows a walkway bracket 1 having an engaging leg 2, a walkway-lumber support bar 3, a brace element 4 and a thrusting flange 5. The engaging leg 2 is hooked into the outer side of a fastening ring 6 which is hanging from a shallow channel on notch 7 in a vertical post 8.

Figure 2:
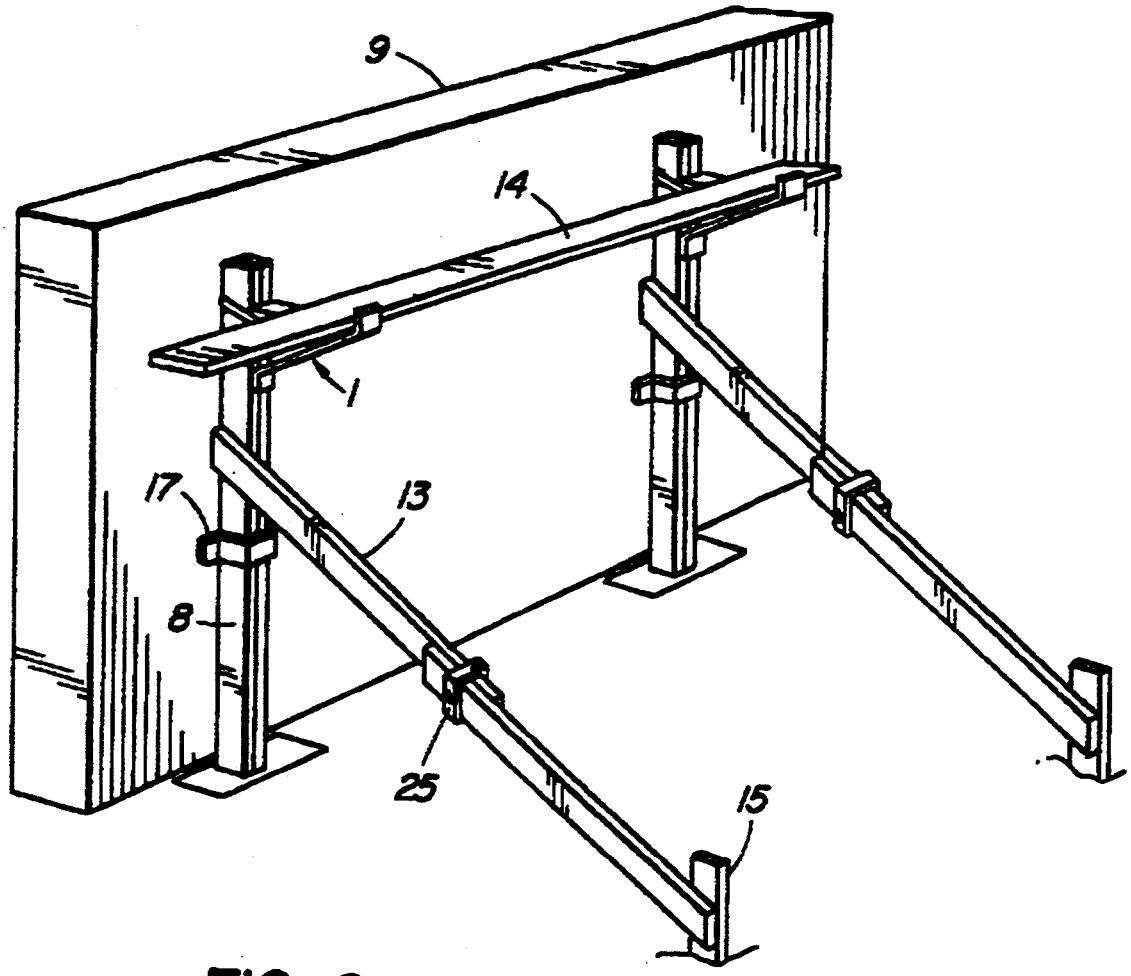
FIG. 2 is a perspective view of a wall against which a series of vertical posts with walkway brackets have been braced by triangularly extending braces.

The vertical post 8, as shown in FIG. 2, is preferably made-up by nailing two lengths of 2×4 lumber together. The notch 7 is formed in the side of the post 8 facing a wall or form 9 to be worked-on. It need be no deeper than that sufficient to retain the ring 6 and provide slack to receive the engaging leg 2.

Figure 3:
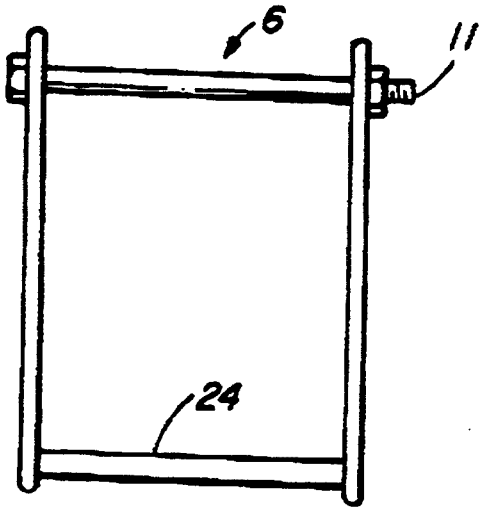
FIG. 3 is a plan view of a rectangular fastening ring with a removable bolt.

The ring 6 is preferably rectangular as shown in FIG. 3, and sized to just slide over the post. Optionally, one side of the rectangle may be a removable bolt 11, while the other side (24) may be fixed, as by welding. This permits the fastening ring (6) to be placed in a hole 12 formed in the post 8 to prevent separation during transport. As this hole may be small and placed near the edge, it may be used in place of the notch 7 as an alternate form of channel and will not weaken the lumber excessively.

The post 8 is braced in the direction perpendicular to the line of the walkway lumber 14 by triangularly placed lengths of lumber serving as braces 13 that extend to the ground where they are fastened, as by stakes 15. These braces may be pieced-up from 2×4's using "C" clamps as shown in FIG. 2. As the lengths of 2×4's are overlapped and clamped, they are not damaged and may be used subsequently for other purposes.

Figure 4:
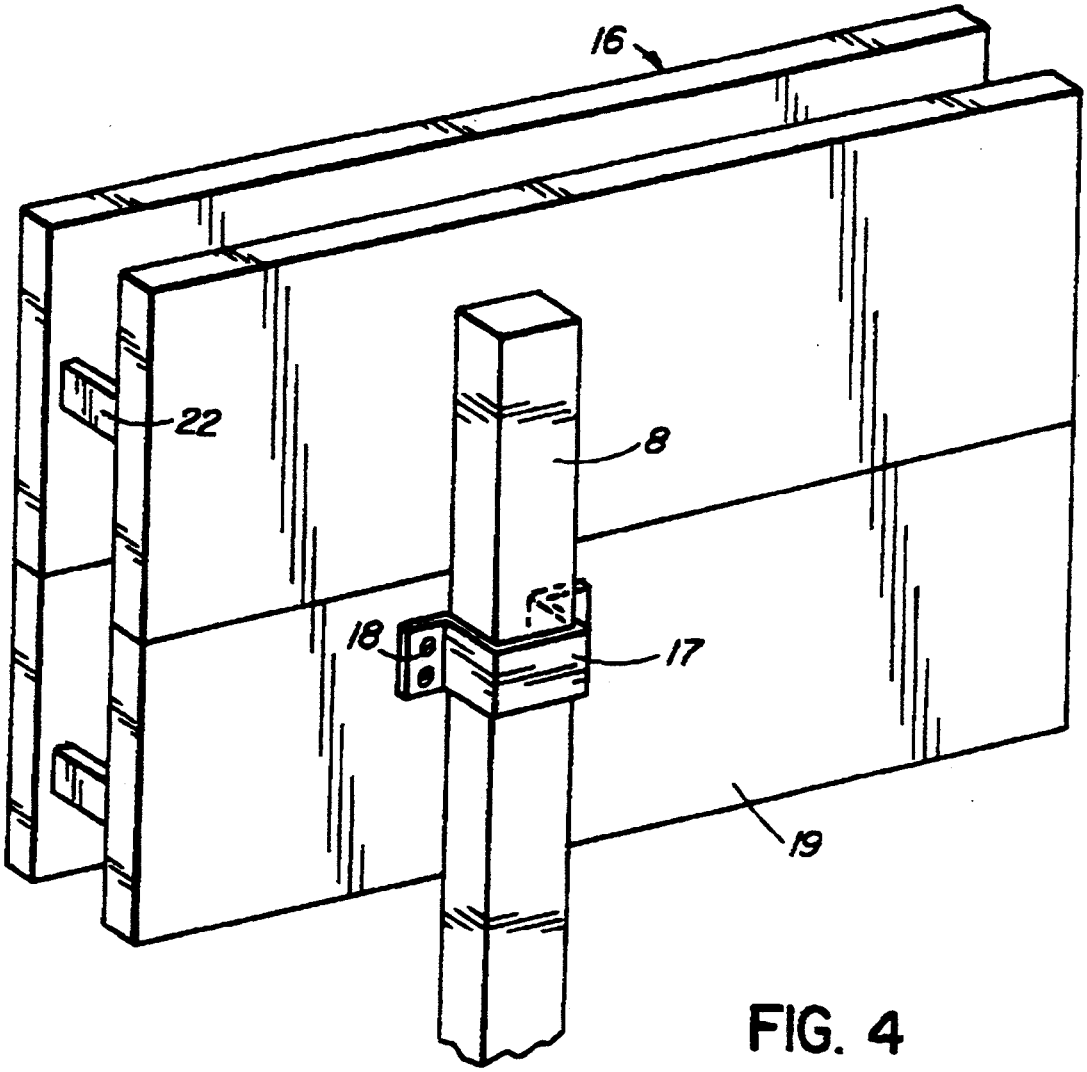
FIG. 4 is a face view of a foam-form wall based on ARGISOL (TM) type blocks, against which a vertical support post has been fastened by a brackets.

When a foam-form wall 16 as shown in FIG. 4 is being constructed, the posts 8 may be retained in a vertical position against the wall by hat-shaped brackets 17. These brackets 17 should be fastened, as by self-taping screws 18, to reinforcing (not shown) within the foam-form wall 16.

An example of a wall 16 particularly suited to this invention is the ARGISOL (TM) wall-produced by The Greenblock Company Ltd. of Woodland Park, Colo., U.S.A. The block 19 provided by this company has a metal flange 22 imbedded within the foam, into which the screws 18 may engage. Other products may provide a flange attached to a rail that is laid between each course of blocks, or some equivalent structure.

Because the brackets 17 have a sliding fit around the posts 8, as the foam-form wall 16 is filled with concrete, it is free to settle. While the brackets 17 subside with the wall, they merely slide along the posts 8, continuing to provide lateral support.

Figure 5:
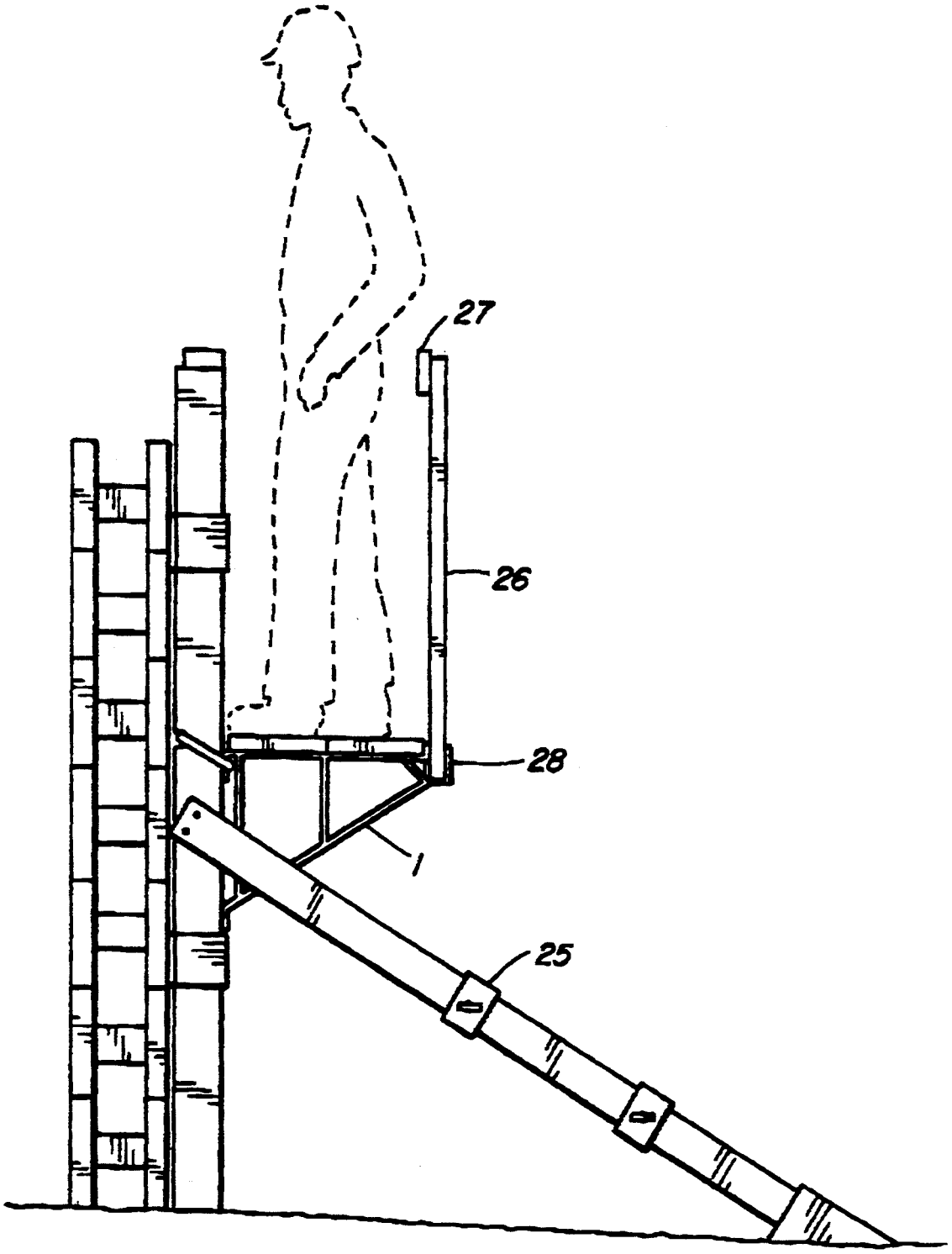
FIG. 5 is a profile view of a walkway with a guard rail.

In FIG. 5, the brackets 1 are modified to provide a fitted socket or rail support means 25 for supporting a guard rail post 26. To this post 26 may be attached on a temporary basis locally available two-by-four lumber as a railing 27.

The post 26 may also be provided from local lumber. Preferably the socket, which may be open on one side as well as the top (if provided with fastening means, such as a bolt or nail, are included) is dimensioned to hold the post 26 in an upright manner.

Incorporation of such a rail support means within the bracket 1 enhances further the value of the walkway support system of the invention, without impairing its portability in any significant manner.

The invention allows a "kit" consisting of walkway brackets 1, fastening rings 6, optionally but preferably "C" clamps 25 and hat-shaped brackets 17, to be carried to a job site where lumber is to be found.

From this a walkway can be temporarily constructed that can easily be disassembled for re-use of all its components.

CONCLUSION

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property is claimed as follows:

1. A walkway assembly in combination with a foam-block wall comprising hollow core foam blocks to be filled with concrete besides which wall said walkway assembly is to be erected, said assembly comprising:

(1) a plurality of vertical support posts standing adjacent to the wall, each of such posts being provided with a channel means in the form of a notch or hole to receive a fastening ring;

(2) a fastening ring installed on each of said posts each such ring being engaged with a respective notch or hole; and (3) a walkway support bracket mounted on each post, each bracket being engaged with a respective fastening ring, such brackets having:

(i) an engaging leg by which they are engaged with their respective fastening ring;

(ii) a horizontal walkway lumber support bar upon which walkway lumber is placed to span the space between adjacent brackets;

(iii) a downwardly angled brace;

(iv) a thrusting flange located at the lower end of the brace and positioned to bear against said post beneath said fastening ring; and (4) vertical support means comprising brackets placed around the support posts for a sliding engagement therewith, said brackets being fastened to said wall to provide lateral support to said posts by which they will remain in a vertical orientation while the walkway is in use, while permitting said wall, including said brackets, to subside when said block cores are filled with concrete, without impairing the integrity of the support provided to the walkway.

2. A walkway assembly as in claim 1 wherein said walkway brackets comprise a rail support means positioned at the outer end of the horizontal bar, in combination with guard rail posts installed in said rail support means and a rail carried by said posts.

* * * * *